US011428084B2

(12) United States Patent
Fraser et al.

(10) Patent No.: US 11,428,084 B2
(45) Date of Patent: Aug. 30, 2022

(54) ADAPTOR APPARATUSES AND METHODS FOR ARTIFICIAL LIFT SYSTEMS

(71) Applicant: Q2 Artificial Lift Services ULC, Red Deer (CA)

(72) Inventors: Garth John Fraser, Red Deer (CA); Corbin Coyes, Calgary (CA)

(73) Assignee: Q2 Artificial Lift Services ULC, Red Deer (CA)

( * ) Notice: Subject to any disclaimer, the term of this patent is extended or adjusted under 35 U.S.C. 154(b) by 0 days.

(21) Appl. No.: 17/062,314

(22) Filed: Oct. 2, 2020

(65) Prior Publication Data

US 2021/0102448 A1 Apr. 8, 2021

Related U.S. Application Data

(60) Provisional application No. 62/911,002, filed on Oct. 4, 2019.

(51) Int. Cl.
*E21B 43/12* (2006.01)

(52) U.S. Cl.
CPC ..... *E21B 43/127* (2013.01)

(58) Field of Classification Search
CPC ..... E21B 17/02; E21B 43/13; E21B 43/127
See application file for complete search history.

(56) References Cited

U.S. PATENT DOCUMENTS

| | | | | |
|---|---|---|---|---|
| 7,428,923 | B2 | 9/2008 | Ford | |
| D682,317 | S | 5/2013 | Carruth et al. | |
| 8,535,024 | B2 | 9/2013 | Conyers et al. | |
| D700,622 | S | 3/2014 | Carruth et al. | |
| D717,834 | S | 11/2014 | Carruth et al. | |
| D717,835 | S | 11/2014 | Carruth et al. | |
| D724,104 | S | 3/2015 | Carruth et al. | |
| 9,341,183 | B1 | 5/2016 | Carruth et al. | |
| 10,184,328 | B1 * | 1/2019 | Holleman | E21B 43/127 |
| 2011/0024370 | A1 * | 2/2011 | Ford | F04B 47/00 210/787 |
| 2016/0237796 | A1 | 8/2016 | Stachowiak et al. | |

* cited by examiner

*Primary Examiner* — David Carroll
(74) *Attorney, Agent, or Firm* — Smith Baluch LLP

(57) ABSTRACT

The disclosure provides an adaptor apparatus for a downhole artificial lift system. The apparatus includes an upper adaptor section and a base adaptor section. The upper adaptor section includes a top connector portion for connecting to first equipment, and a neck portion below the top connector portion. The base adaptor section includes a bottom connector portion for connecting to second equipment. The base adaptor section and the neck section define a longitudinal fluid passage therethrough. The upper adaptor section includes slots extending from the fluid passage to an outer surface of the neck. The upper adaptor section also includes a plurality of fluid channels recessed in the outer surface of the upper adaptor piece.

19 Claims, 12 Drawing Sheets

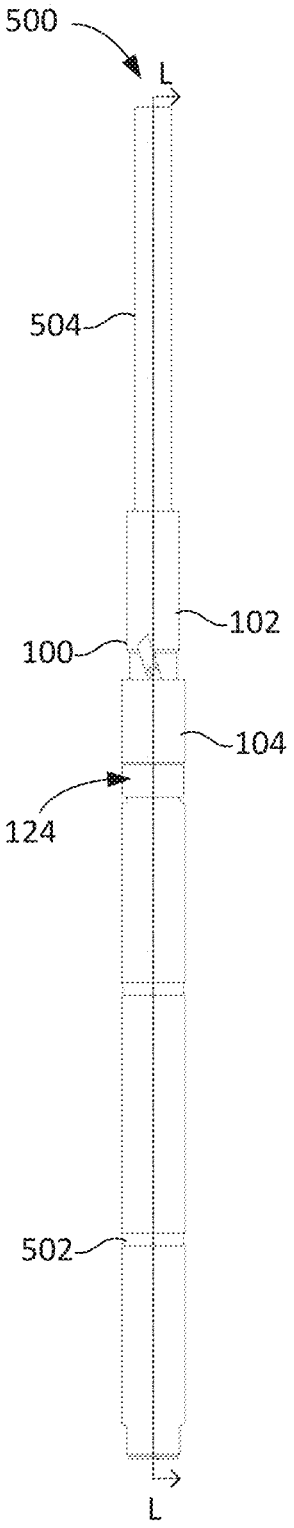
FIG. 24
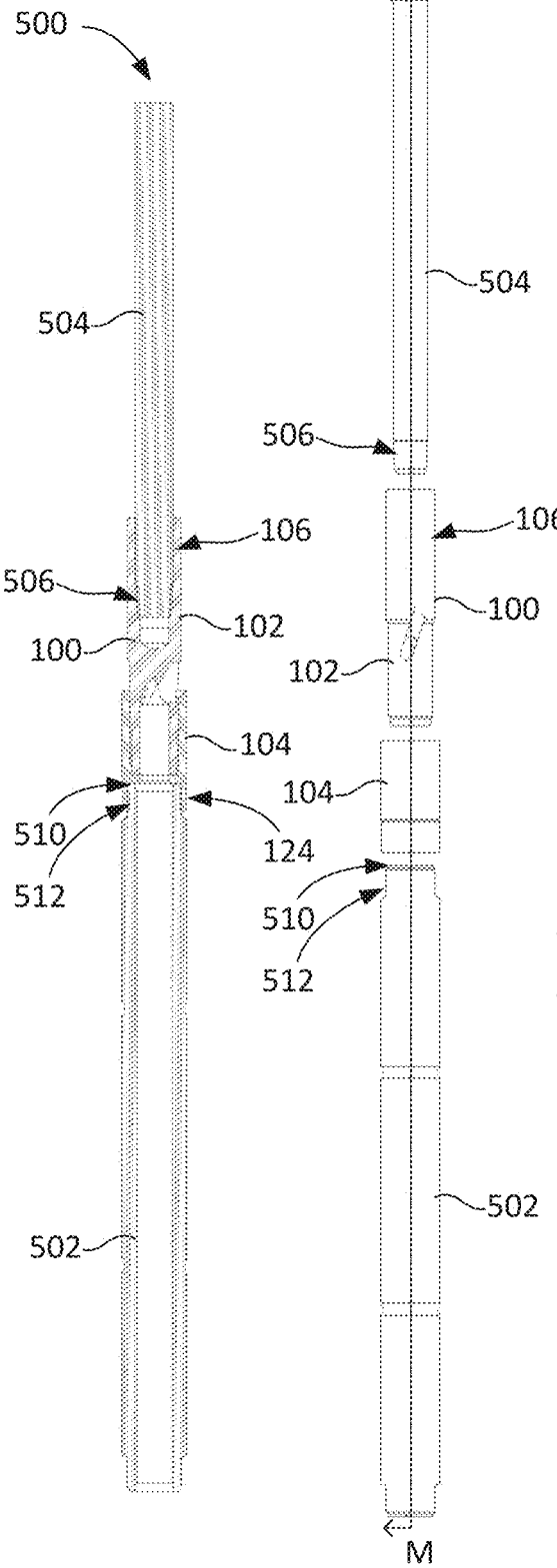
FIG. 25
FIG. 26
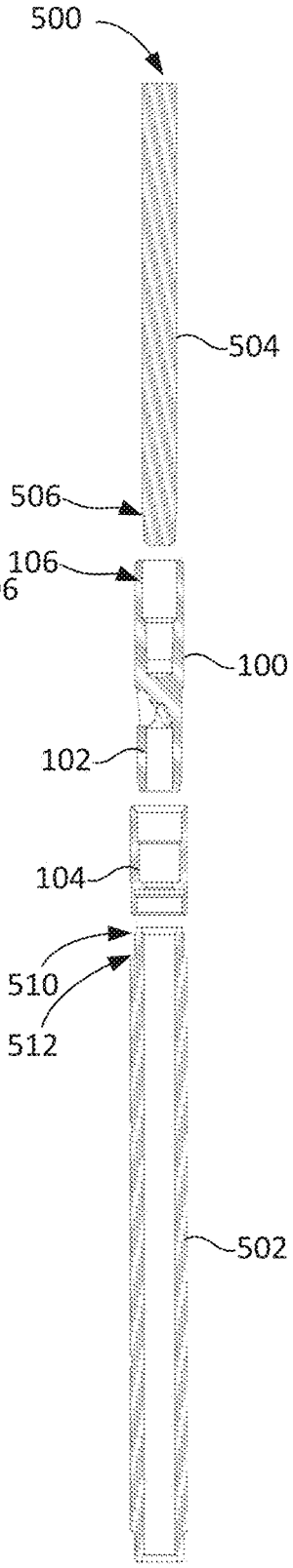
FIG. 27

ADAPTOR APPARATUSES AND METHODS FOR ARTIFICIAL LIFT SYSTEMS

RELATED APPLICATION

This application claims priority to U.S. Application No. 62/911,002, filed Oct. 4, 2019, the entire content of which is incorporated herein by reference.

FIELD OF THE DISCLOSURE

The present application relates to artificial lift systems such as reciprocating downhole pumps. More particularly, the present application relates to adaptor apparatuses for interconnecting a plunger and a reciprocating rod or a hollow tube, such as a pull tube or hollow valve rod.

BACKGROUND

In hydrocarbon recovery operations, an artificial lift system is typically used to recover fluids from a well in a subterranean earth formation. Common artificial lift systems include reciprocating pumps such as sucker rod pumps. The pump may generally comprise a plunger disposed within a barrel. The plunger is moved up and down within the barrel in order to draw fluids to the surface. More particularly, the plunger may be coupled to a lower end of a reciprocating rod or rod string, for example. The rod string may be referred to as a "sucker rod." The upper end of the plunger may be coupled to a valve rod, and the valve rod may, in turn, be coupled to the sucker rod. The valve rod may be simply referred to as a "rod" herein. The valve rod may be a solid structure (i.e. not hollow). However, rather than a solid valve rod, a hollow tube may interconnect the sucker rod and the plunger. The hollow tube may be referred to as a "pull tube" or "hollow valve rod".

The upward travel of the plunger may be referred to as the "upstroke" and the downward travel may be referred to as the "downstroke". Valves in the plunger and/or barrel may be configured such that, on the downstroke, the fluid is trapped in the barrel and flows through the plunger. On the upstroke, fluid above the plunger is lifted, and new fluid enters the barrel.

The fluid in the well may contain solid particulates such as sand. Hydraulic fracturing processes may increase the presence of sand and other particulates within well fluids. Particulates that settle around the upper end of the plunger may cause wear of the plunger and/or barrel over time.

SUMMARY

According to an aspect, there is provided an adaptor apparatus for coupling between a rod and a plunger in a downhole artificial lift system, the apparatus comprising: an upper adaptor section comprising: a top connector portion for coupling to first equipment; and a neck portion below the top connector portion; and a base adaptor section comprising: a bottom connector portion, below the neck portion, for coupling to second equipment, the base adaptor section and the neck portion defining a longitudinal fluid passage therethrough, wherein the neck portion comprises at least one slot extending from an outer surface of the neck portion to the fluid passage and, for each at least one slot, a respective fluid channel recessed into the outer surface of the upper adaptor section.

In some embodiments, the first equipment comprises the rod, and the second equipment comprises the plunger.

In some embodiments, each slot is a perforation extending radially through the neck portion, each perforation having a shape that is elongated along a slot axis, the slot axis extending axially and circumferentially, relative to the neck portion, and being angled relative to a longitudinal axis of the upper adaptor section by more than zero degrees.

In some embodiments, each at least one slot has an obround-shaped profile.

In some embodiments, each at least one fluid channel extends from a respective upper end of the corresponding slot.

In some embodiments, each at the least one fluid channel is spaced from a respective upper end of the corresponding slot.

In some embodiments, each at least one fluid channel generally upwards and at an angle to the longitudinal axis of the upper adaptor section.

In some embodiments, for each fluid channel, the angle of the fluid channel matches the slot axis of the corresponding slot.

In some embodiments, the fluid channels each define a helical path.

In some embodiments, the fluid channels each define a straight path.

In some embodiments, the fluid channel decreases in depth as it extends upward and away from the corresponding slot.

In some embodiments, each fluid channel has a respective flat floor.

In some embodiments, each fluid channel has a respective rounded floor.

In some embodiments, the apparatus further comprises a collar portion intermediate the bottom connector portion and the neck portion, the collar portion having a larger outer diameter than the neck portion and the top connector portion.

In some embodiments, wherein: the upper adaptor section is an upper adaptor piece, and the base adaptor section is a base adaptor piece, wherein the base adaptor piece is removably connectable to the upper adaptor piece; the upper adaptor piece comprising the top connector portion and the neck portion; and the base adaptor piece comprising the collar portion and the bottom connector portion.

In some embodiments, the base adaptor piece comprises an upper connector in the collar portion for selectively coupling the base adaptor piece to: the upper adaptor piece; and when the upper adaptor piece is removed, a hollow valve rod.

In some embodiments, the upper adaptor piece has a lower connector portion below the neck portion, and the collar portion of the base adaptor piece connects to the lower connector portion of the upper adaptor piece.

According to another aspect, there is provided an adaptor apparatus for a downhole artificial lift system, the apparatus comprising: an upper adaptor piece comprising: a top connector portion for connecting to first equipment; and a neck portion below the top connector portion, the neck portion defining a first fluid passage therein; a base adaptor piece removably connectable to the upper adaptor piece and comprising a collar portion and a bottom connector portion for connecting to second equipment, the base adaptor piece defining a second fluid passage therethrough that communicates with the first fluid passage, wherein the base adaptor piece comprises an upper connector in the collar portion for selectively coupling the base adaptor piece to: the upper adaptor piece; and when the upper adaptor piece is removed, a hollow valve rod.

According to another aspect, there is provided assembly for a downhole artificial lift system comprising: a plunger; a reciprocating rod; an upper adaptor section comprising: a top connector portion for coupling to the rod; and a neck portion below the top connector portion; and a base adaptor section comprising: a bottom connector portion, below the neck portion, coupled to the plunger, the base adaptor section and the neck portion defining a longitudinal fluid passage therethrough, wherein the neck portion comprises at least one slot extending from an outer surface of the neck portion to the fluid passage and, for each at least one slot, a respective fluid channel recessed into the outer surface of the upper adaptor section.

According to another aspect, there is provided a method comprising: connecting the adaptor apparatus as described herein between a plunger and a reciprocating rod.

In some embodiments, the method further comprises flowing fluid through the adaptor apparatus.

Other aspects and features of the present disclosure will become apparent, to those ordinarily skilled in the art, upon review of the following description of the specific embodiments of the disclosure.

BRIEF DESCRIPTION OF THE DRAWINGS

The present disclosure will be better understood having regard to the drawings in which:

FIG. 24 a side view of an example partial pump assembly including the adaptor apparatus of FIGS. 1 to 8;

FIG. 25 is a cross sectional view taken along the line L-L in FIG. 24;

FIG. 26 is an exploded side view of the assembly of FIGS. 24 and 25;

FIG. 27 is a cross sectional view taken along the line M-M in FIG. 26;

DETAILED DESCRIPTION

Figure 1:
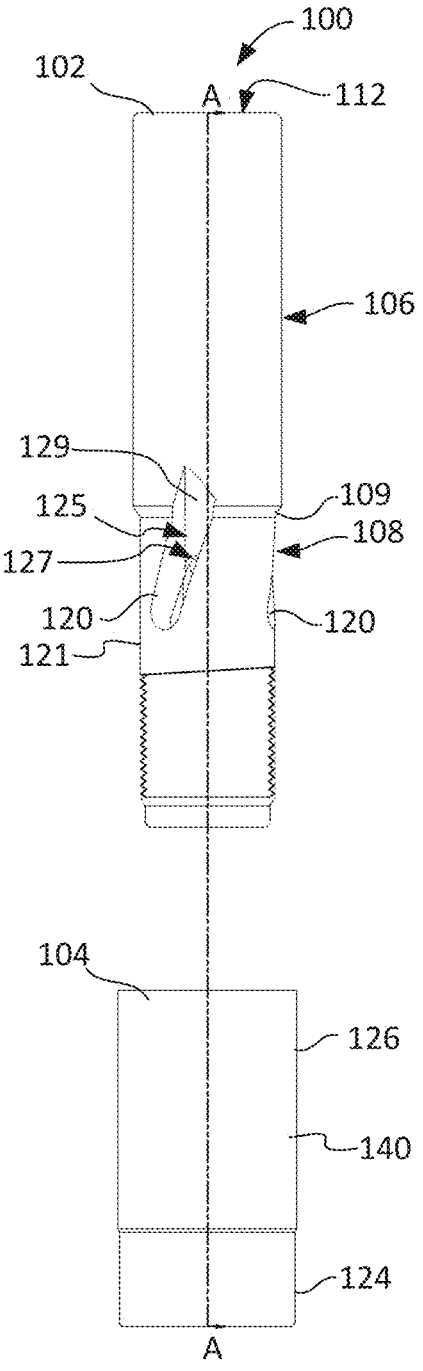
FIG. 1 is an exploded side view of an example adaptor apparatus according to some embodiments.

In an artificial lift system, an adaptor apparatus may interconnect an upper end of a plunger and a lower end of a valve rod or other reciprocating member that moves the plunger. The adaptor apparatus may be configured to help prevent sand and other particulates from settling around the upper end or leading edge of the plunger. The adaptor apparatus may comprise a collar or other structure configured to wipe the inner surface of the barrel to help prevent particulates from moving below the adaptor apparatus toward the plunger. However, existing adaptor apparatuses may not sufficiently move sand away from the adaptor apparatus and the plunger. Existing apparatuses may also not be sufficiently wear resistant and the particulates within the fluid may cause wear in the adaptor apparatus over time, thereby reducing its effectiveness.

The adaptor apparatus according to an aspect of the disclosure may comprise upper and base adaptor pieces that are connectable and able to be disconnected. The upper adaptor piece may be interchangeable with other upper adaptor pieces, and the base adaptor piece may also be interchangeable. The base adaptor piece may comprise a collar portion for wiping the inner surface of the barrel. An outer surface of the base adaptor piece may comprise a wear-resistant coating. The upper adaptor piece may comprise a fluid passage and one or more slots to allow fluid to flow from the fluid passage to an exterior of the upper adaptor piece. The slots may be obround, oblong or other elongate shapes. Fluid channels may be defined in the outer surface of the upper adaptor piece. The channels may have a depth that is less than the thickness of the upper adaptor piece. The channels may extend generally axially upwards from the slots, and the depth of the channels may decrease as they extend upward and away from the slots. This decrease in depth may occur at any pitch or angle relative to the central axis of the upper adaptor piece. Each fluid channel may have a respective flat or rounded floor. Various modifications and variations of these features of the apparatus may also be implemented.

In the following description, like reference numerals in the drawings indicate like components or features.

Figure 2:
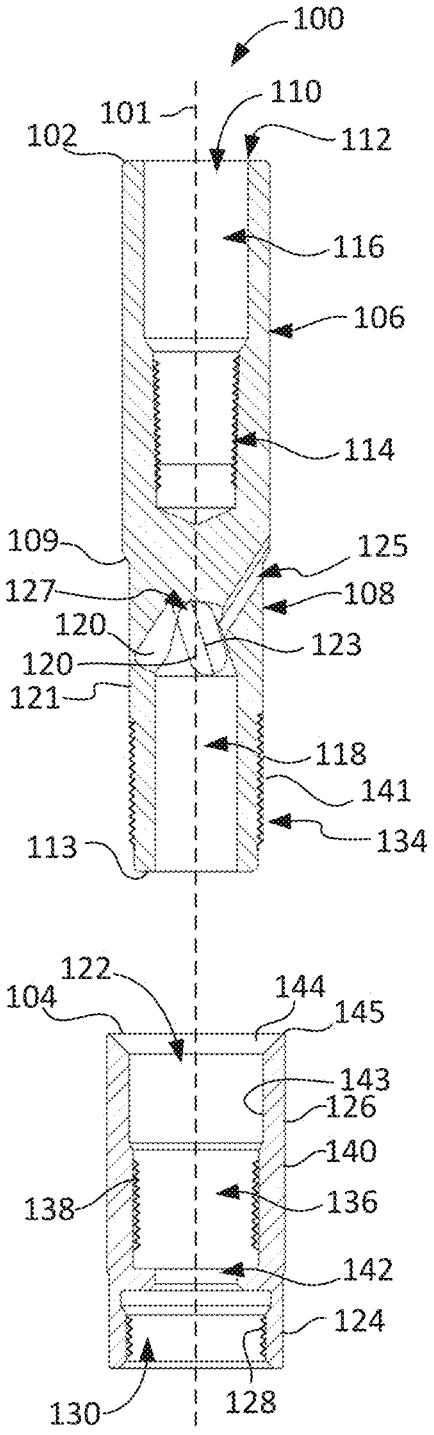
FIG. 2 is an exploded side cross-sectional view of the adaptor apparatus taken along the line A-A in FIG. 1.
Figure 3:
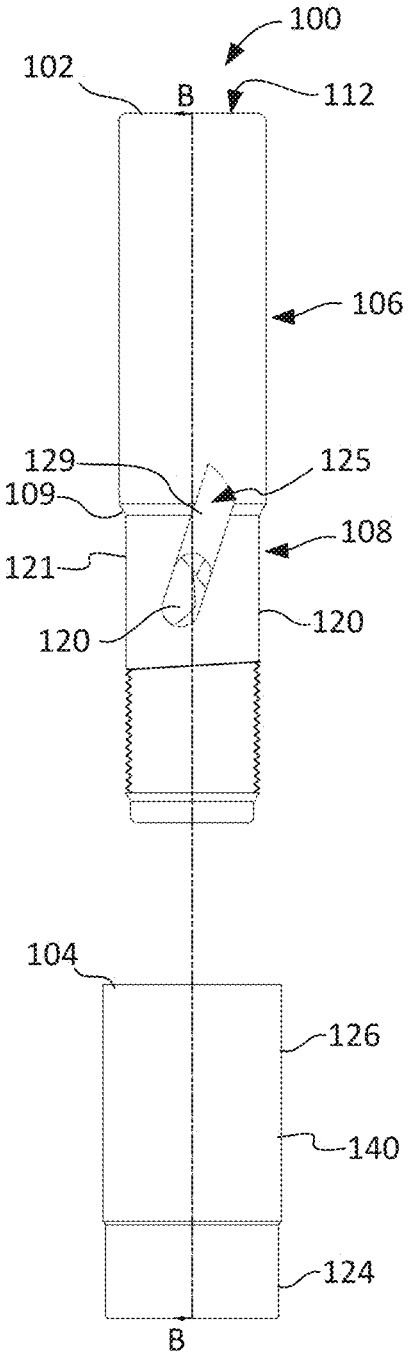
FIG. 3 is an exploded side view of the example adaptor apparatus of FIGS. 1 and 2, but rotated about its longitudinal axis relative to FIGS. 1 and 2.
Figure 4:
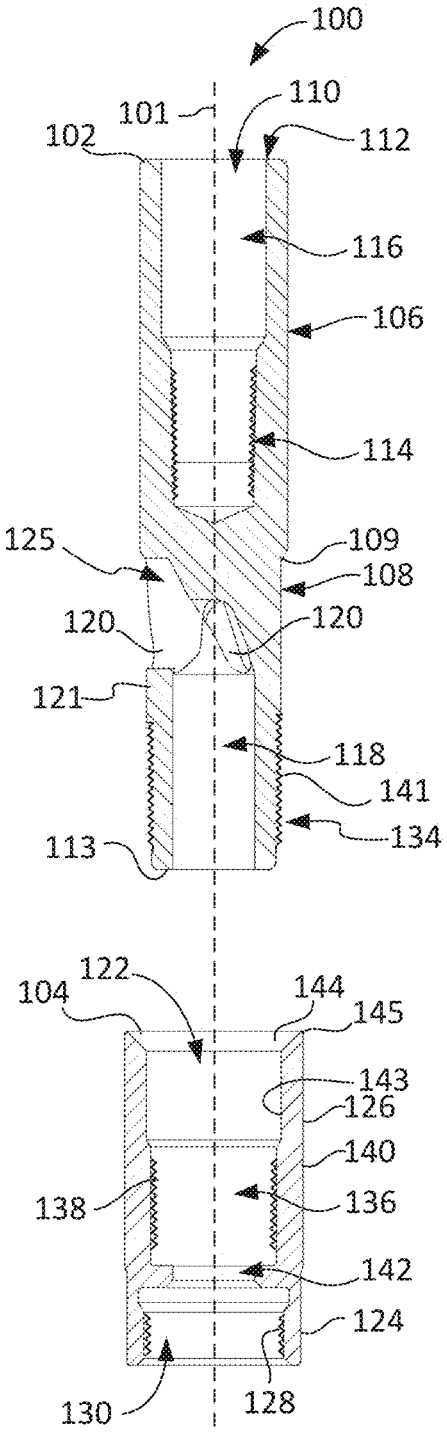
FIG. 4 is an exploded side cross-sectional view of the adaptor apparatus taken along the line B-B in FIG. 3.

A first embodiment of an example adaptor apparatus is shown in FIGS. 1 to 8. FIG. 1 is an exploded side view of an example adaptor apparatus 100 according to some embodiments. FIG. 2 is an exploded side cross-sectional view of the adaptor apparatus 100 taken along the line A-A in FIG. 1. FIG. 3 is an exploded side view of the example adaptor apparatus 100 of FIGS. 1 and 2, but rotated about its longitudinal axis 101 relative to FIGS. 1 and 2. FIG. 4 is an exploded side cross-sectional view of the adaptor apparatus 100 taken along the line B-B in FIG. 3.

The apparatus 100 is elongate and has a central longitudinal axis 101 shown in FIGS. 2 and 4. Thus, in the following description, the term "longitudinal" will refer to a direction parallel with the longitudinal axis 101, and the term "radial" will refer to a radial direction with respect to the longitudinal axis 101.

The apparatus 100 may interconnect first and second equipment in a downhole reciprocating pump system. The first equipment may be a reciprocating valve rod coupled to a sucker rod, for example. The first equipment may comprise a hollow tube such as a pull tube or hollow valve rod. The second equipment may be a plunger. For example, the adaptor apparatus may directly interconnect an upper "pin" end of a plunger and a lower end of a reciprocating rod. However, embodiments are not limited to the adaptor apparatus being positioned directly between the rod and the plunger. For example, additional equipment may also be positioned between the plunger and the rod, and the apparatus 100 may connect to such equipment rather than directly to the rod and/or plunger.

Referring to FIGS. 1 to 4, the example adaptor apparatus 100 comprises an upper adaptor piece 102 and a base adaptor piece 104. The base adaptor piece 104 is positioned below the upper adaptor piece 102. The upper adaptor piece 102 and the base adaptor piece 104 are removably attachable in this embodiment, as will be explained in more detail below. The upper adaptor piece 102 may be interchangeable with other upper adaptor pieces having the same or different configurations. This may allow the adaptor apparatus to be adapted or customized for various applications. The base adaptor piece 104 may also be replaceable or interchangeable with other base adaptor pieces having the same or different configurations.

However, rather than two separate connectable adaptor pieces that are removable from one another, the adaptor apparatus 100 described herein may be securely connected and/or integrated with one another. For example, the adaptor apparatus 100 may be formed as a unitary body, with an upper adaptor section having the general structure of the upper adaptor piece 102 and a lower adaptor section having the general structure of the base adaptor piece 104, but without a releasable connection between the two sections. In some embodiments, the base adaptor section may be rotatable about the longitudinal relative to the upper adaptor section. In some embodiments, the base adaptor section may be removable from the upper adaptor section but not adapted to connect to a hollow valve rod. Other variations in connection and/or integration of the upper and base sections are also possible.

The upper adaptor piece 102 in this embodiment comprises a top connector portion 106 and a neck portion 108 below the top connector portion 106. The top connector portion 106 optionally has a larger outer diameter than the neck portion 108 such that an annular shoulder 109 is formed between the top connector portion 106 and the neck portion 108.

The top connector portion 106 is configured to connect to a lower end of a reciprocating rod (such as valve rod 504 in FIGS. 24 to 27) or other equipment. Optionally, the top connector portion 106 comprises a longitudinal bore 110 extending downward from a top end 112 of the upper adaptor piece 102. The longitudinal bore 110 extends part way through the upper adaptor piece 102, terminating before the neck portion 108 in this example. The longitudinal bore 110 comprises inner threads 114 for engaging outer threads of a lower end of the rod. However, embodiments are not limited to threaded connection between the adaptor apparatus 100 and the rod or other equipment. Any suitable means of connection may be used including, but not limited to, fastening hardware (e.g. screws, bolts), clamps, etc.

Optionally, an upper section 116 of the bore 110 (above the threads 114) has an inner diameter only slightly larger than the outer diameter of a section of the rod received therein, which may provide lateral support for the connection.

The neck portion 108 of the upper adaptor piece 102 defines a first longitudinal fluid passage 118 therein (shown in FIGS. 2 and 4). In this example, the fluid passage 118 is in the form of a central longitudinal bore through the neck portion 108. The fluid passage 118 opens to a bottom end 113 of the upper adaptor piece 102. The fluid passage 118 is not in communication with the bore 110 in the top connector portion 106 in this embodiment. However, in other embodiments, the fluid passage 118 may extend through the entire upper adaptor piece 102.

The neck portion 108 comprises at least one slot 120 extending radially through the neck portion (i.e. radially from the first fluid passage 118 to the outer surface 121 of the neck portion. The slots in this embodiment are elongated helical slots, but the slots may have other configurations in other embodiments. The neck portion 108 in this example comprises three obround slots 120, which are spaced around the circumference of the neck.

In this example, each obround slot 120 is a perforation extending radially through the neck portion 108. Each slot 120 has a shape that is elongated along a slot axis 123 (see FIG. 2), where the slot axis extends axially and circumferentially relative to the neck portion 108. The slot axis 123 is angled laterally relative to a longitudinal axis of the upper adaptor piece by more than zero degrees. More specifically, in this example, the slots 120 each have an elongated obround-shaped profile. The obround-shaped profile has a lengthwise slot axis 123 (see FIG. 2) at an 18 degree angle to the longitudinal axis 101 of the upper adaptor piece 102. However, embodiments are not limited to any particular length, shape, or angle of the slots 120.

In this embodiment, the upper adaptor piece 102 further defines at least one fluid channel 125 recessed into its outer surface. Specifically, for each slot 120, a respective fluid channels 125 extends from an upper end 127 of the slot 120, where the fluid channel 125 is a groove recessed into the outer surface 121 of the neck portion 108 (i.e. not extending completely through to the fluid passage 118). Rather, the fluid channels 125 have a depth that tapers and reduces as the channels 125 extend from the slots 120. The rate or angle of the taper may vary. In other embodiments, the depth of the channels 125 may not be tapered. The angle of the taper may be approximately 27 degrees, for example, although the angle may vary. This decrease in depth may occur at any pitch or angle relative to the central axis of the upper adaptor piece. Each fluid channel 125 may have a floor 129. The floors 129 of the fluid channels 125 in this example are flat in the dimension transverse to the path of the fluid channel 125 (i.e. a flat transverse profile). The flat transverse profile may provide for ease of manufacturing the fluid channels 125. The floor 129 of the fluid channel 125 is also straight and flat in the longitudinal dimension of the fluid channel 125. Thus, the floor 129 is planar with a slight tapered pitch and the fluid channels 125 extend in a straight path in this embodiment.

Alternatively, in other embodiments, the channels may have a floor that is curved or arcuate in the dimension transverse to the path of the fluid channel (e.g. a concavely curved transverse profile). The channels of other embodiments may also be curved along the longitudinal path of the channel. For example, the channels may follow helical paths in other embodiments.

The lengthwise angle of the fluid channels 125, relative to the longitudinal axis 101 of the upper adaptor piece 102, may be equivalent to the angle of the obround slot 120 axis 123. That is, the fluid channels 125 may be longitudinally aligned with the elongate shape of the obround slots 120. In the embodiment of FIGS. 1 to 8, the fluid channels 125 follow a straight path at a longitudinal angle that matches the angle of the obround slots 120 (18 degrees in this example). The pitch angle of the fluid channels 125 may vary in other embodiments. The fluid channels 125 extend upward past the annular shoulder 109 in this embodiment. Embodiments are not limited to a particular path, length or shape of the channels 125.

The fluid channels 125 are connected to the obround slots 120 in this embodiment, but in other embodiments the fluid channels 125 may be separate from the obround slots 120. In other embodiments, the fluid channels 125 may be omitted.

The fluid channels 125 may follow a straight or helical path. Embodiments are also not limited to a particular helix angle of the fluid channels 125. As will be explained below in more detail, the slots 120 and/or channels 125 may help prevent sand from settling around the apparatus 100 and/or the upper end of the plunger (such as plunger 502 shown in FIGS. 24 to 27).

The base adaptor piece 104 of the adaptor apparatus 100 defines a second longitudinal fluid passage 122 therethrough (shown in FIGS. 2 and 4). The second longitudinal fluid passage 122 communicates with the first longitudinal fluid passage 118 of the upper adaptor piece 102. The base adaptor piece 104 comprises a bottom connector portion 124 and a collar portion 126, which is generally cylindrical. The bottom connector portion 124 connects to the upper end of a plunger (such as plunger 502 in FIGS. 24 to 27) in this embodiment. The bottom connector portion 124 in this example comprises inner threads 128 in a lower passage portion 130 of the fluid passage 122. The lower passage portion 130 and inner threads 128 are sized and configured to engage outer threads of a connector positioned at an upper end of the plunger (such as pin end connector 512 of the plunger 502 shown in FIGS. 25 and 27). The base adaptor piece 104 may thereby be mounted to the plunger. For example, the bottom connector portion 124 (including threads 128) may be in the form of a box thread configured to screw directly onto an American Petroleum Institute (API) standard pin end plunger. In other embodiments, the bottom connector portion 124 may be a pin thread end and the upper end of the plunger may comprise a box thread to receive the pin thread end of the apparatus 100. Embodiments are not limited to threaded connection between the apparatus 100 and the plunger or other equipment. Any suitable means of connection may be used including, but not limited to, fastening hardware (e.g. screws and/or bolts), clamps, etc.

The base adaptor piece 104 of the apparatus 100 connects to the upper adaptor piece 102. Referring to FIGS. 2 and 4, in this embodiment, the collar portion 126 receives a lower connector portion 134 of the upper adaptor piece 102 therein such that the collar portion 126 partially overlaps the upper adaptor piece 102. More specifically, the passage 122 in the collar portion 126 includes an upper passage portion 136 of the passage 122 with inner threads 138 therein. The upper passage portion 136 and the inner threads 138 therein are sized and configured to engage outer threads 141 of the lower connector portion 134 of the upper adaptor piece 102. Embodiments are not limited to threaded connection between the upper and base adaptor pieces 102 and 104 of the apparatus 100. Any suitable means of connection may be used including, but not limited to, fastening hardware (e.g. screws and/or bolts), clamps, etc.

The collar portion 126 is positioned above the bottom connector portion 124 in this embodiment, and the collar portion 126 has a cylindrical outer surface 140 with a larger outer diameter than the upper adaptor piece 102 of the apparatus 100. The collar portion 126 may have an outer diameter that is very close to, but slightly less than, the inner diameter of the barrel (not shown). The outer diameter of the collar portion 126 may be chosen to fit in the barrel with an extremely tight clearance. For example, the clearance may be chosen to be in the range of −0.002 to −0.005 inches. However, embodiments are not limited to a particular outer diameter or clearance range. The larger diameter collar portion 126 may be omitted in other embodiments. For example, the base adaptor piece 104 may simply be a tubular member connected to the upper adaptor piece 102 with a bottom connector to couple the tubular member to the plunger.

The collar portion 126 may thus wipe the surface of the barrel on the upstroke to help prevent sand or other particulates in the fluid from moving below the collar and settling on or around the upper end of the plunger. This may, in turn, reduce wear of the plunger and/or the barrel over time, thereby extending the life of the pump system.

In this embodiment, the passage 122 through the base adaptor piece 104 optionally includes the lower passage portion 130, the upper passage portion 136 and an intermediate passage portion 142 between the lower passage portion 130 and the upper passage portion 136. The intermediate passage portion 142 has a smaller inner diameter than the lower passage portion 130 and the upper passage portion 136. Thus, the intermediate passage portion 142 may act as a stop for the upper end of the plunger (received in the lower passage portion 130) and the lower connector portion 134 of the upper adaptor piece (received in the upper passage portion 136).

Referring to FIGS. 2 and 4, the collar portion 126 may partially overlap the neck portion 108 of the upper adaptor piece 102. The collar portion 126 may have an upper surface 144 that extends from an inner surface 143 of the collar portion 126 to the outer surface 140. Optionally, the upper surface 144 may extend at an angle radially outward and upward from the neck portion 108, thereby forming an upper lip 145 of the collar portion 126. This angled upper surface 144 may help guide settling sand and other particulates back to through the slots 120 toward the interior of the plunger.

The upper surface 144 may, for example, be angled at approximately 45 degrees relative to the longitudinal axis 101, but embodiments are not limited to any particular angle. The outer surface 140 of the collar portion 126 may wipe the inner surface of the barrel during the upstroke. The angled upper surface 144 may help guide particulates away from the surface of the barrel and toward the slots 120, which may help prevent particulates from settling on the leading edge of the plunger. In other embodiments, the surface 144 may simply be at a right angle relative to the longitudinal axis 101, rather than extending at an upward angle to form a lip.

Figure 5:
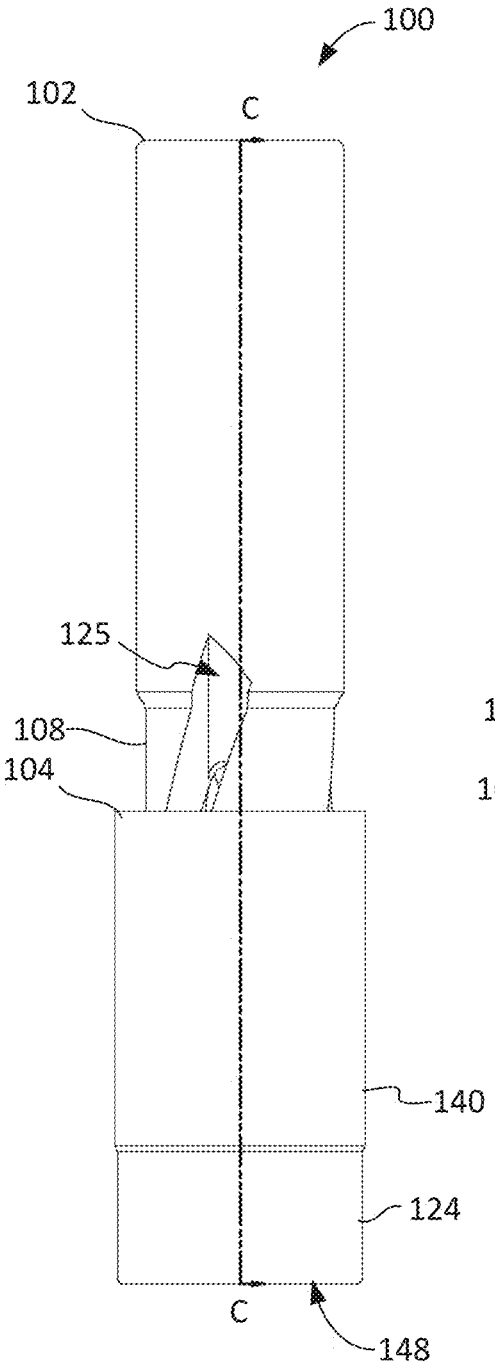
FIG. 5 is a side view of the adaptor apparatus of FIGS. 1 to 4 with upper and base adaptor pieces connected.
Figure 6:
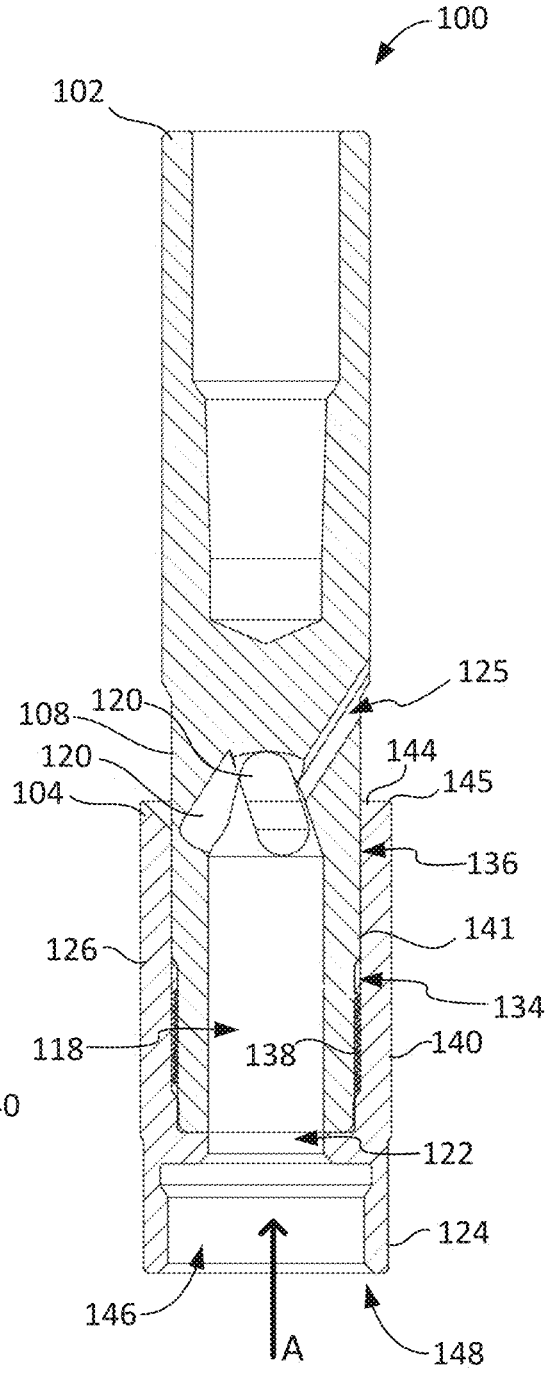
FIG. 6 is a cross-sectional side view of the adaptor apparatus taken along the line C-C in FIG. 5.
Figure 7:
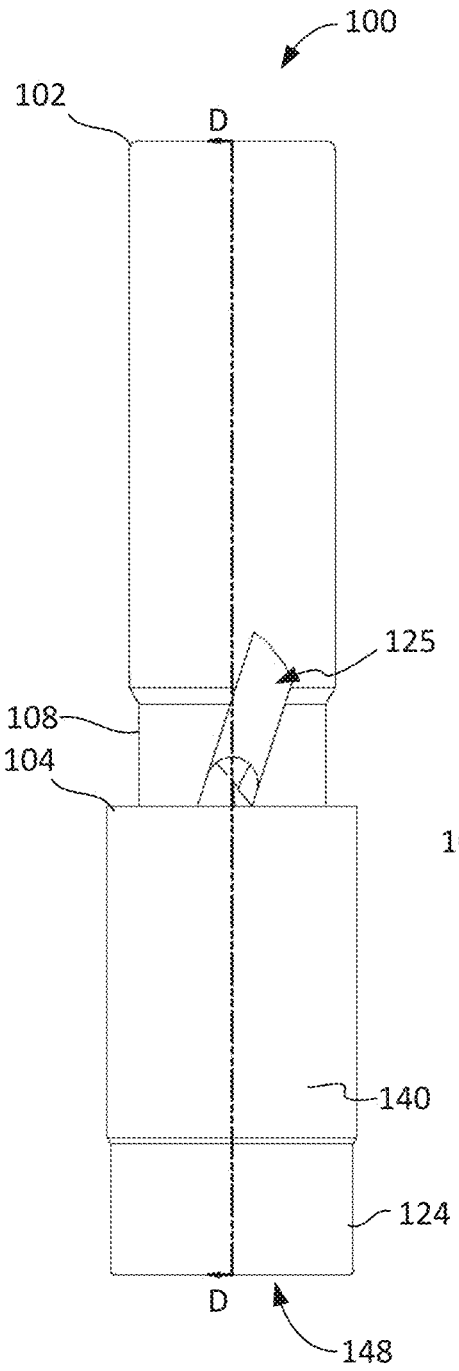
FIG. 7 is a side view of the adaptor apparatus, but rotated about its longitudinal axis relative to FIG. 5.
Figure 8:
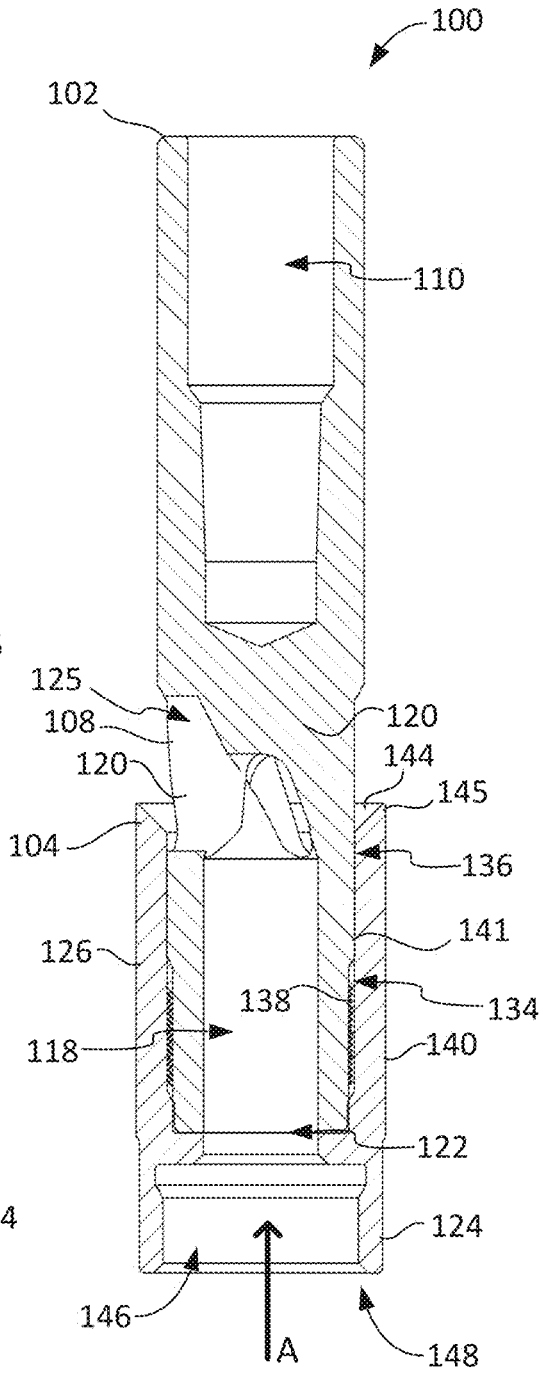
FIG. 8 is a cross-sectional side view of the adaptor apparatus taken along the line D-D in FIG. 7.

FIG. 5 is a side view of the adaptor apparatus 100 with the upper and base adaptor pieces 102 and 104 connected. FIG. 6 is a cross-sectional side view of the adaptor apparatus 100 taken along the line C-C in FIG. 5. FIG. 7 is a side view of the adaptor apparatus 100 with the upper and base adaptor pieces 102 and 104 connected, but rotated about its longitudinal axis 101 relative to FIG. 5. FIG. 8 is a cross-sectional side view of the adaptor apparatus 100 taken along the line D-D in FIG. 7.

As shown in FIGS. 6 and 8, the upper adaptor piece 102 is partially received in the upper passage portion 136 of the base adaptor piece 104, with the inner threads 138 of the base adaptor piece 104 engaging the outer threads 141 of the lower connector portion 134 of the upper adaptor piece 102. The base adaptor piece 104 overlaps the lower connector portion 134 and also partially overlaps the slots 120 in the neck portion 108 in this example.

With the upper and base adaptor pieces 102 and 104 connected, the fluid passages 122 and 118 together form a fluid passage 146 through the adaptor apparatus 100.

In operation, fluid exiting the upper end of the plunger (e.g. on the downstroke) enters the passage 146 through a bottom end 148 of the apparatus 100 in the direction of the arrow labelled "A" in FIG. 6. The fluid travels upward through the passage 146 and exits through the obround slots 120. The angled profile of the obround slots 120 and the angle of the aligned fluid channels 125 (relative to the longitudinal axis 101) may cause the fluid exiting therefrom to form a vortex flow in the annulus between the apparatus 100 and the barrel. The angle of the obround profile of the slots 120 may generate some vortex effect on its own. The fluid channels 125 may amplify or increase the vortex effect. This vortex flow may cause particulates in the fluid to flow upwards after exiting from the slots 120. This upward movement of the particulates may, in turn, help prevent the particulates from settling around the collar portion 126 or slipping between the collar portion 126 and the barrel and/or moving downward toward the plunger.

In some embodiments, one or more outer surfaces of the apparatus 100 may be reinforced with a wear resistant layer. For example, the collar portion 126 essentially wipes the inner surface of the barrel and may wear over time. Thus, the outer surface 140 of the collar 126 portion (or the entire outer surface of the base adaptor piece 104) may be coated with a wear resistant material to reduce wear from the wiping movement. In some embodiments, the wear-resistant coating comprises a metal or metal composite coating. The metal or metal composite coating may comprise a tungsten-based or nickel-based spray coating. The tungsten-based spray coating may, for example, comprise a High Velocity Oxygen Fuel (HVOF) tungsten carbide spray coating or any other suitable coating. The tungsten-based spray coating may provide a hardness scale value of 68-70 HRC. The nickel-based wear-resistant spray coating, for example, may comprise a thermally sprayed and fused nickel-based coating with or without carbide constituents. Embodiments are not limited to any particular hardness, coating type or method of application.

The outer surface 140 may be ground to a very high surface finish and precision outer diameter. For example, the outer surface 140 may have a surface roughness value of 16 RA or less.

Another embodiment of an example adaptor apparatus 200 is shown in FIGS. 9 to 14. The adaptor apparatus 200 in FIGS. 9 to 14 is structurally and functionally similar to the embodiment of FIGS. 1 to 8, with some differences discussed below.

Figures 9, 10, 11, 12:
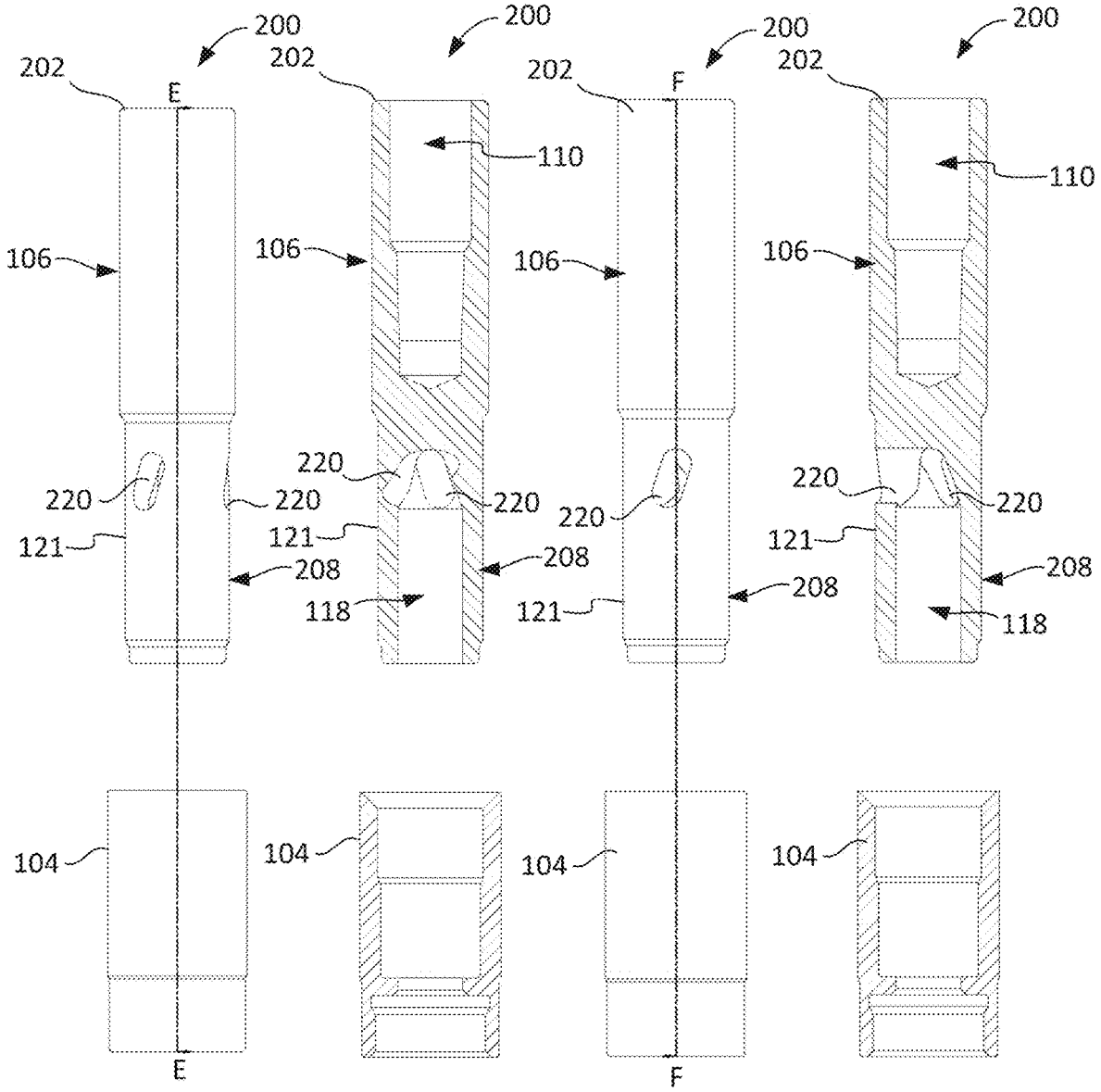
FIG. 9 is an exploded side view of an example adaptor apparatus according to some embodiments.
FIG. 10 is an exploded side cross-sectional view of the adaptor apparatus taken along the line E-E in FIG. 9.
FIG. 11 is an exploded side view of the example adaptor apparatus of FIGS. 9 and 10, but rotated about its longitudinal axis relative to FIGS. 9 and 10.
FIG. 12 is an exploded side cross-sectional view of the adaptor apparatus taken along the line F-F in FIG. 11.
Figure 13:
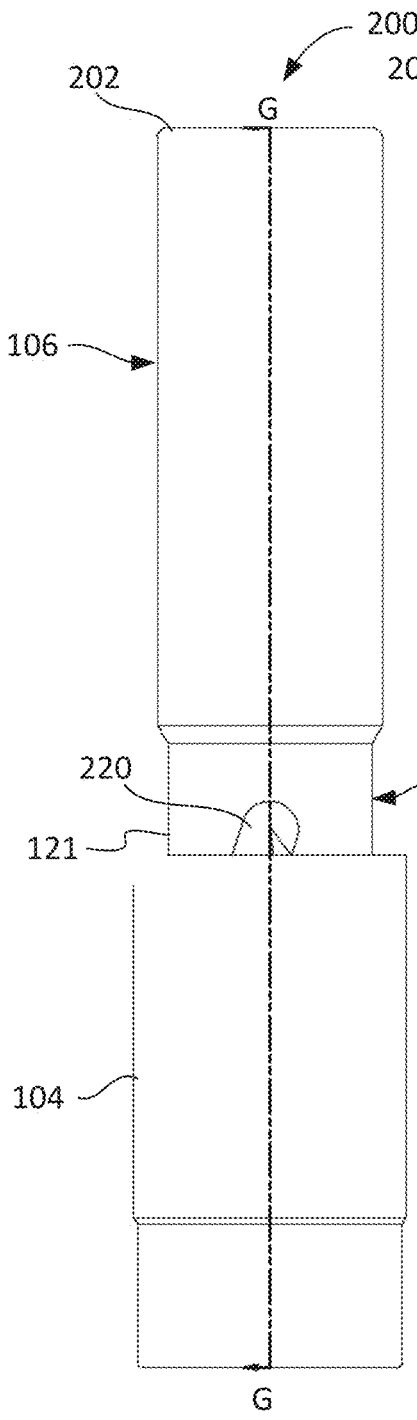
FIG. 13 is a side view of the adaptor apparatus of FIGS. 9 to 12 with upper and base adaptor pieces connected.
Figure 14:
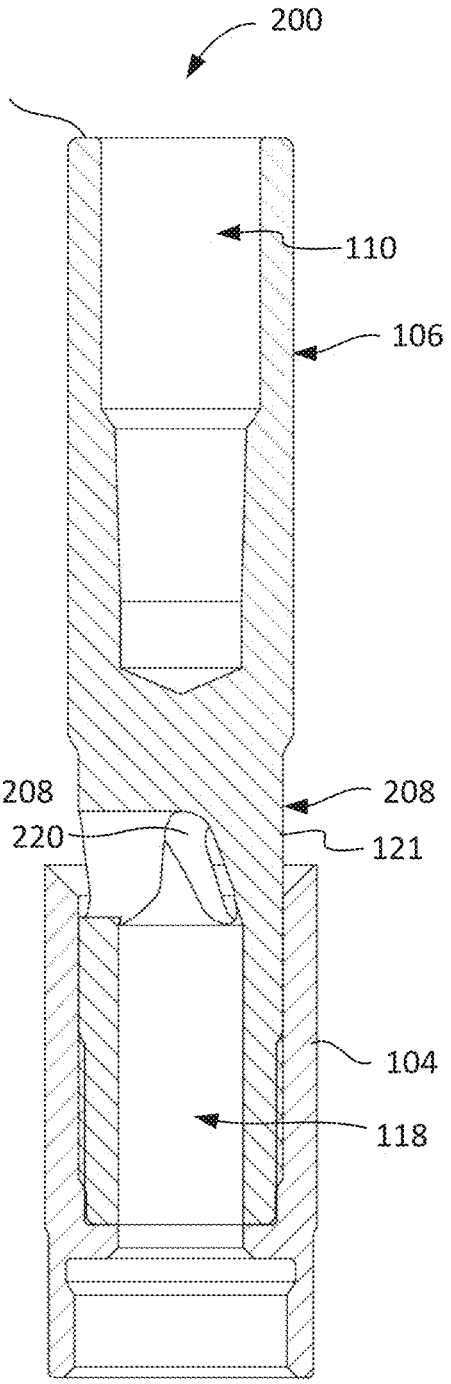
FIG. 14 is a cross-sectional side view of the adaptor apparatus taken along the line G-G in FIG. 13.

FIG. 9 is an exploded side view of an example adaptor apparatus 200 according to some embodiments. FIG. 10 is an exploded side cross-sectional view of the adaptor apparatus 200 taken along the line E-E in FIG. 9. FIG. 11 is an exploded side view of the example adaptor apparatus 200 of FIGS. 9 and 10, but rotated about its longitudinal axis 101 relative to FIGS. 1 and 2. FIG. 12 is an exploded side cross-sectional view of the adaptor apparatus 200 taken along the line F-F in FIG. 11. FIG. 13 is a side view of the adaptor apparatus 200 as assembled. FIG. 14 is a cross-sectional side view of the adaptor apparatus 200 taken along the line G-G in FIG. 13.

With reference to FIGS. 9 to 14, the adaptor apparatus 200 comprises an upper adaptor piece 202 and a base adaptor piece 104. The base adaptor piece 104 is equivalent to the previous described embodiment (shown in FIGS. 1 to 8).

The upper adaptor piece 202 and the base adaptor piece 104 are removably attachable. The upper adaptor piece 202 may be interchangeable with other upper adaptor pieces having the same or different configurations. This may allow the adaptor apparatus to be adapted or customized for various applications. The base adaptor piece 104 may also be replaceable or interchangeable with other base adaptor pieces having the same or different configurations.

However, in other embodiments, the upper and base adaptor pieces 202 and 104 may be may be securely connected and/or integrated with one another. For example, the adaptor apparatus 200 may be formed as a unitary body, with an upper adaptor section having the general structure of the upper adaptor piece 202 and a lower adaptor section having the general structure of the base adaptor piece 104, but without a releasable connection between the two sections. The larger outer diameter collar section 126 may optionally be omitted in any such embodiments where the upper and base are integrated rather than separate removable pieces. The base adaptor section may simply be a tubular section, for example, without a collar.

The upper adaptor piece 202 in this embodiment comprises a top connector portion 106 and a neck portion 208 below the top connector portion 106. The top connector portion 106 is configured to connect to a lower end of a reciprocating rod (such as valve rod 504 in FIGS. 24 to 27) or other equipment. Optionally, the top connector portion 106 comprises a longitudinal bore 110 extending downward from a top end 112 of the upper adaptor piece 202. The longitudinal bore 110 extends part way through the upper adaptor piece 202, terminating before the neck portion 208 in this example. The longitudinal bore 110 may comprise inner threads (not shown) for engaging outer threads of a lower end of a reciprocating rod. However, embodiments are not limited to threaded connection between the apparatus 200 and the rod or other equipment.

The adaptor apparatus 200 of FIGS. 9 to 14 includes a plurality of obround-shaped slots 220 that extend radially through the neck portion to the first longitudinal fluid passage 118 therein. However, the fluid channels 125 of the embodiment shown in FIGS. 1 to 8 are omitted in the adaptor apparatus 200 of FIGS. 9 to 14. This embodiment of the adaptor apparatus 200 may, thus, be simpler to manufacture and may still impart a vortex component to the upward fluid flow from the apparatus 200.

Other than the omission of the fluid channels, the upper connector piece 202 is similar to the upper adaptor piece 102 in FIGS. 1 to 8. Thus, though not shown in FIGS. 9 to 14, the upper adaptor piece 202 may include inner threads in the top connector portion 106 (for connecting to a rod string), and outer threads at the lower end of the neck portion 208 for connecting to the base adaptor piece 104. Similarly, the base adaptor piece 104 may include threads for connecting to the upper adaptor piece 202 and a plunger.

Yet another embodiment of an example adaptor apparatus 300 is shown in FIGS. 15 to 20. The adaptor apparatus 300 in FIGS. 15 to 20 is structurally and functionally similar to the embodiment of FIGS. 1 to 8, with some differences discussed below.

Figures 15, 16, 17, 18:
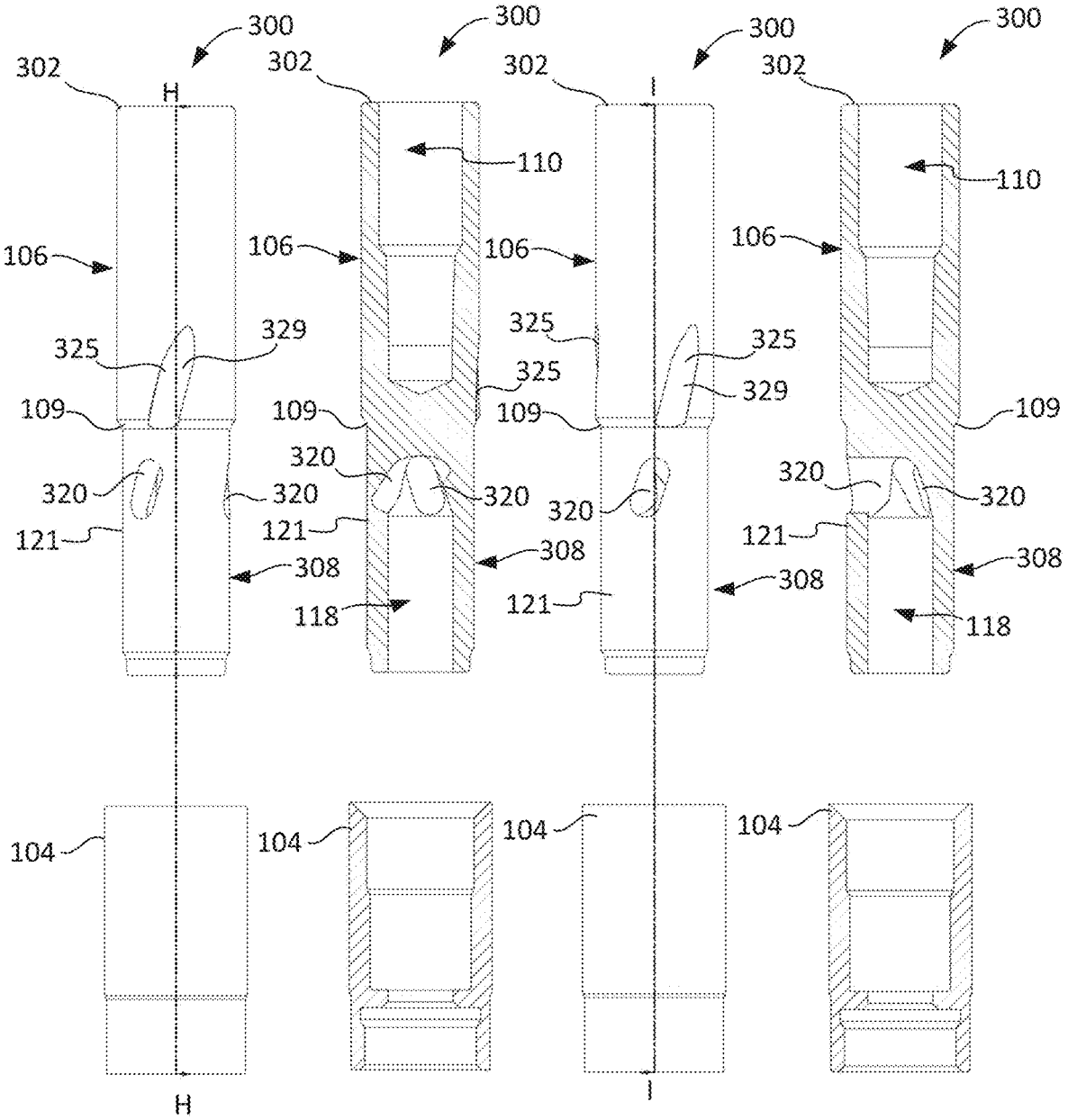
FIG. 15 is an exploded side view of an example adaptor apparatus according to some embodiments.
FIG. 16 is an exploded side cross-sectional view of the adaptor apparatus taken along the line H-H in FIG. 15.
FIG. 17 is an exploded side view of the example adaptor apparatus of FIGS. 15 and 16, but rotated about its longitudinal axis relative to FIGS. 15 and 16.
FIG. 18 is an exploded side cross-sectional view of the adaptor apparatus taken along the line I-I in FIG. 17.
Figure 19:
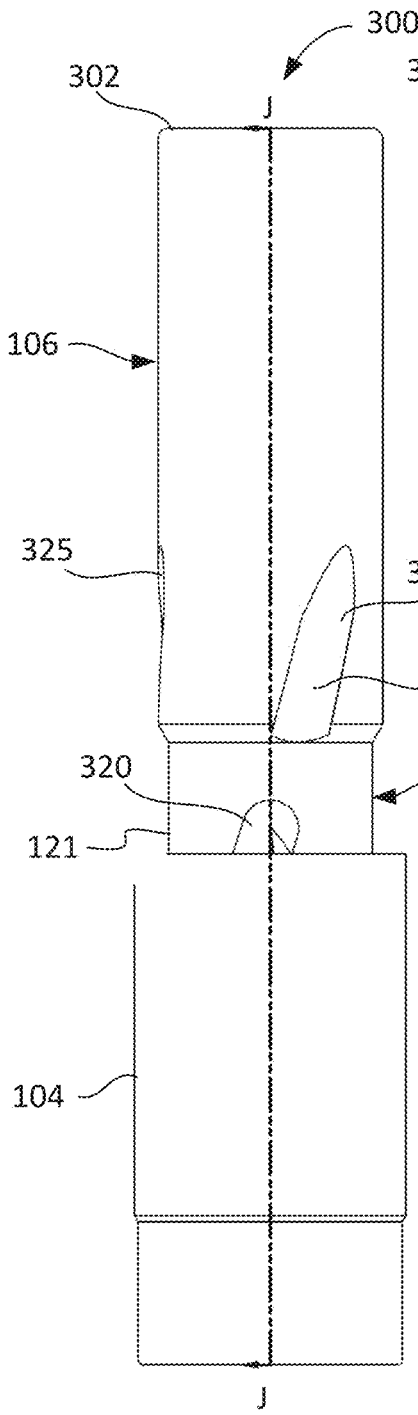
FIG. 19 is a side view of the adaptor apparatus of FIGS. 15 to 18 with upper and base adaptor pieces connected.
Figure 20:
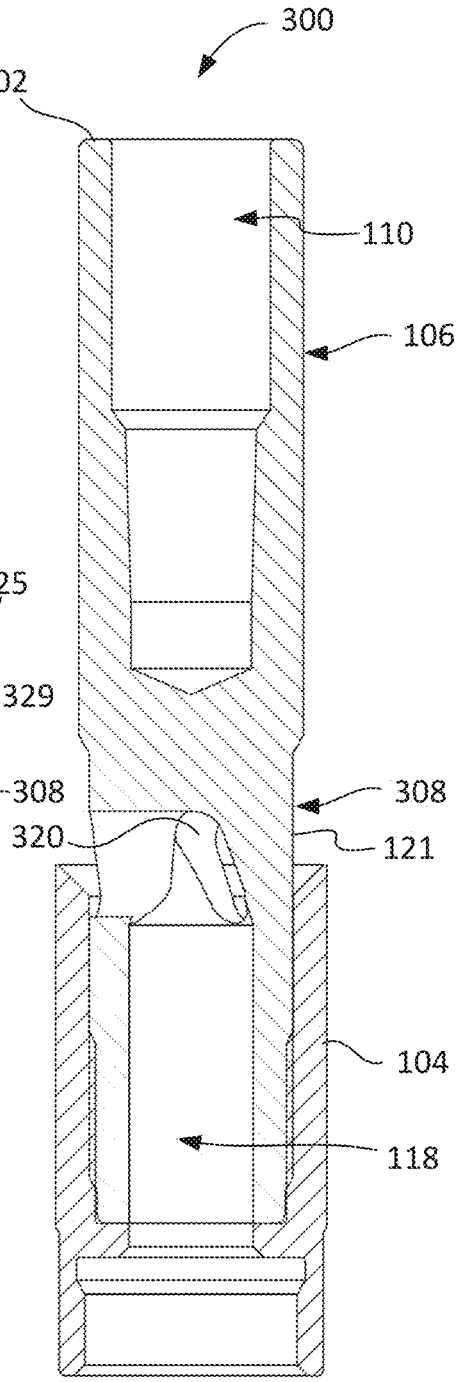
FIG. 20 is a cross-sectional side view of the adaptor apparatus taken along the line J-J in FIG. 19.

FIG. 15 is an exploded side view of an example adaptor apparatus 300 according to some embodiments. FIG. 16 is an exploded side cross-sectional view of the adaptor apparatus 300 taken along the line H-H in FIG. 15. FIG. 17 is an exploded side view of the example adaptor apparatus 300 of FIGS. 15 and 16, but rotated about its longitudinal axis 101 relative to FIGS. 15 and 16. FIG. 18 is an exploded side cross-sectional view of the adaptor apparatus 300 taken along the line I-I in FIG. 17. FIG. 19 is a side view of the adaptor apparatus 300 with the upper and base adaptor pieces 302 and 104 connected. FIG. 20 is a cross-sectional side view of the adaptor apparatus 300 taken along the line J-J in FIG. 19.

With reference to FIGS. 15 to 20, the adaptor apparatus 300 comprises an upper adaptor piece 302 and a base adaptor piece 104. The base adaptor piece 104 is equivalent to the previous described embodiments (shown in FIGS. 1 to 14).

The upper adaptor piece 302 and the base adaptor piece 104 are removably attachable. The upper adaptor piece 302 may be interchangeable with other upper adaptor pieces having the same or different configurations. This may allow the adaptor apparatus to be adapted or customized for various applications. The base adaptor piece 104 may also be replaceable or interchangeable with other base adaptor pieces having the same or different configurations. However, in other embodiments, the upper and base adaptor pieces 302 and 104 may be may be securely connected and/or integrated with one another. For example, the adaptor apparatus 300 may be formed as a unitary body, with an upper adaptor section having the general structure of the upper adaptor piece 302 and a lower adaptor section having the general structure of the base adaptor piece 104, but without a releasable connection between the two sections.

The upper adaptor piece 302 in this embodiment comprises a top connector portion 106 and a neck portion 308 below the top connector portion 106. The top connector portion 106 is configured to connect to a lower end of a reciprocating rod (such as valve rod 504 in FIGS. 24 to 27) or other equipment. Optionally, the top connector portion 106 comprises a longitudinal bore 110 extending downward from a top end 112 of the upper adaptor piece 302. The longitudinal bore 110 extends part way through the upper adaptor piece 302, terminating before the neck portion 308 in this example. The longitudinal bore 110 may comprise inner threads (not shown) for engaging outer threads of a lower end of a reciprocating rod. However, embodiments are not limited to threaded connection between the apparatus 300 and the rod or other equipment.

Similar to the embodiment of FIGS. 1 to 8, the adaptor apparatus 300 of FIGS. 15 to 20 includes a plurality of obround-shaped slots 320 that extend radially through the neck portion to the first longitudinal fluid passage 118 therein, and a plurality of fluid channels 325 are provided. However, fluid channels 325 shown are not connected directly to the slots 320. Rather, each fluid channel 325 is spaced axially upward from, and aligned with, a corresponding slot 320. The fluid channels 325 in this example start at the annular shoulder 109 and extend at an angle aligned with the slots 320. The fluid channels 325 may contribute to or impart a vortex component to the upward fluid flow from the apparatus 300.

The fluid channels 325 in this embodiment have floor surfaces 329 that are concavely curved in the dimension transverse to the path of the fluid channel 325. In other words, the fluid channels 325 have a rounded or curved transverse profile. The curved profile may have reduced boundary layer surface area to cross-sectional flow area ratio (compared to flat channel floors), which may reduce kinetic energy loss. The fluid channels 325 also follow a straight longitudinal path (i.e. do not have longitudinal curvature). In this the fluid channels 325 also have a longitudinal path that is angularly aligned with the angle of the obround slots 320 (approximately 18 degrees relative to the axial direction).

Though not shown in FIGS. 15 to 20, the upper adaptor piece 302 may include inner threads in the top connector portion 106 (for connecting to a rod string), and outer threads at the lower end of the neck portion 308 for connecting to the base adaptor piece 104. Similarly, the base adaptor piece 104 may include threads for connecting to the upper adaptor piece 302 and a plunger.

Figures 21, 22, 23:
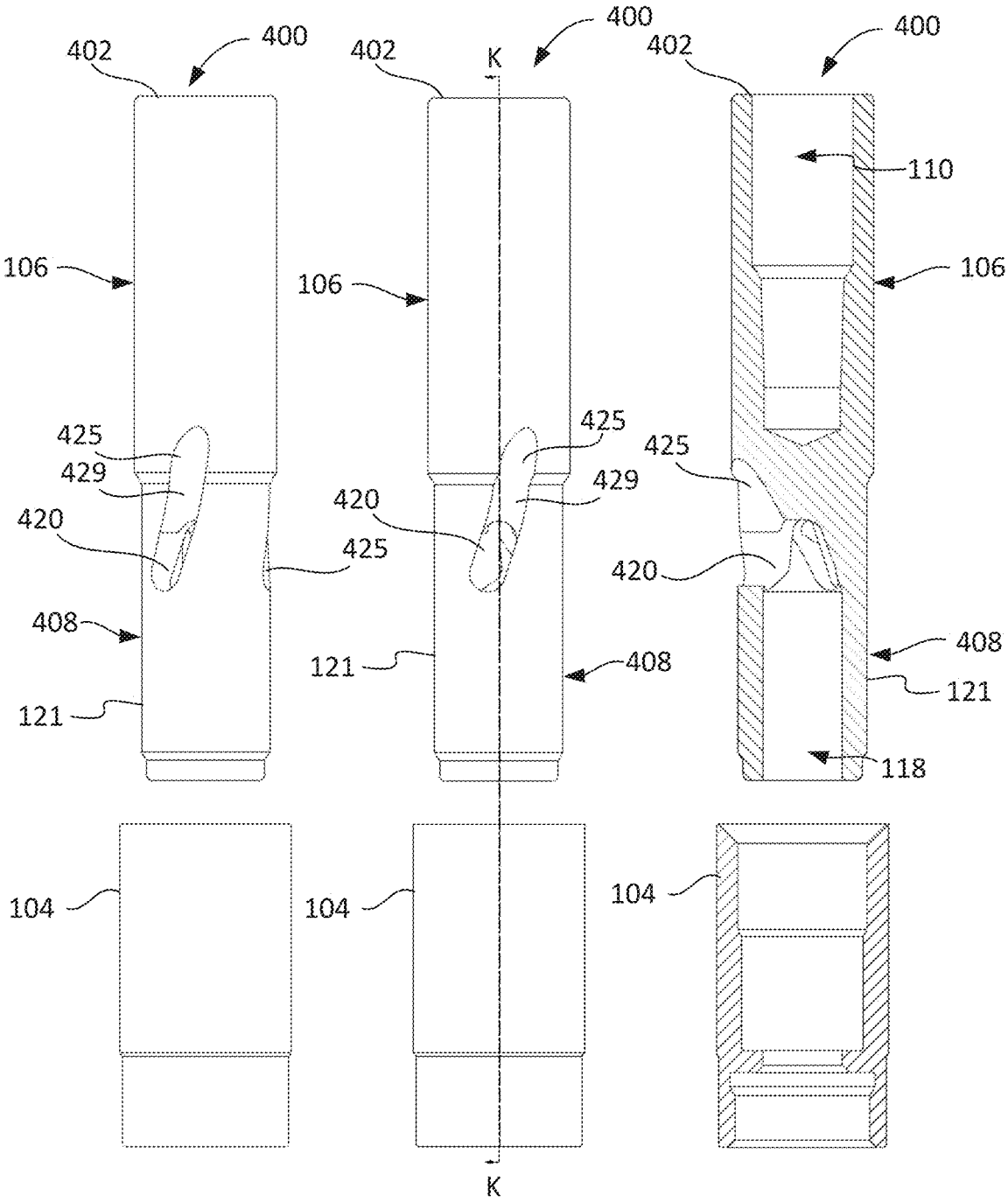
FIG. 21 is an exploded side view of yet another example adaptor apparatus according to some embodiments.
FIG. 22 is an exploded side view of the example adaptor apparatus of FIG. 21, but rotated about its longitudinal axis relative to FIG. 21.
FIG. 23 is an exploded side cross-sectional view of the adaptor apparatus taken along the line K-K in FIG. 22.

FIG. 21 is an exploded side view of yet another example adaptor apparatus 400 according to some embodiments. FIG. 22 is an exploded side view of the example adaptor apparatus 400 of FIG. 21, but rotated about its longitudinal axis 101 relative FIG. 21. FIG. 23 is an exploded side cross-sectional view of the adaptor apparatus 400 taken along the line K-K in FIG. 22.

With reference to FIGS. 21 to 23, the adaptor apparatus 400 comprises an upper adaptor piece 402 and a base adaptor piece 104. The base adaptor piece 104 is equivalent to the previous described embodiments (shown in FIGS. 1 to 20).

The upper adaptor piece 402 and the base adaptor piece 104 are removably attachable. The upper adaptor piece 402 may be interchangeable with other upper adaptor pieces having the same or different configurations. The base adaptor piece 104 may also be replaceable or interchangeable with other base adaptor pieces having the same or different configurations. However, in other embodiments, the upper and base adaptor pieces 402 and 104 may be may be securely connected and/or integrated with one another. For example, the adaptor apparatus 400 may be formed as a unitary body, with an upper adaptor section having the general structure of the upper adaptor piece 402 and a lower adaptor section having the general structure of the base adaptor piece 404, but without a releasable connection between the two sections.

The upper adaptor piece 402 in this embodiment comprises a top connector portion 106 and a neck portion 408 below the top connector portion 106. The top connector portion 106 is configured to connect to a lower end of a reciprocating rod (such as valve rod 504 in FIGS. 24 to 27) or other equipment. The top connector portion 106 comprises a longitudinal bore 110 extending downward from a top end 112 of the upper adaptor piece 402. The longitudinal bore 110 may comprise inner threads (not shown) for engaging outer threads of a lower end of a reciprocating rod.

Similar to the embodiment of FIGS. 1 to 8, the adaptor apparatus 400 of FIGS. 21 to 23 includes a plurality of obround-shaped slots 420 that extend radially through the neck portion to the first longitudinal fluid passage 118 therein, and a plurality of fluid channels 425 are provided. However, fluid channels 425 have a rounded transverse profile (i.e. the floor 429 of the slots is rounded transverse to the lengthwise path of the channels 425. The fluid channels 425 follow a generally helical path (i.e. the path is angled and curved about the longitudinal axis 101 in a helical manner). Similar to other fluid channels described herein, the channels 425 are at an angle of approximately 18 degrees from the longitudinal axis 101, although this angle may vary. The fluid channels 425 also have a depth that decreases as the channel extends upward and away from the corresponding slots 420. The fluid channels 425 have a right-handed helical path, or in other words, clockwise rotation about the axis 101 as the channels 425 extend upward. The fluid channels extend longitudinally at an angle that approximately matches the angle of the obround slots 420. The helical paths of the channels 435 may reduce kinetic energy loss (compared to straight paths) due to a more gradual change in direction of the fluid flow through the channels. Straight channels, on the other hand, may increase turbulence generated further from the device's axis, particularly near the pump barrel wall. This may help to keep sand and other particulates moving upwards and outwards, keeping them in suspension longer, and may help prevent them from settling on onto the leading edge of the plunger. Channels with straight paths may be easier to manufacture with some equipment.

FIGS. 24 to 27 illustrate an assembly 500 for a downhole pump system including an example plunger 502, a reciprocating rod 504, and the adaptor apparatus 100 of FIGS. 1 to 8. FIG. 24 a side view of the assembly 500. FIG. 25 is a cross sectional view taken along the line L-L in FIG. 24. FIG. 26 is an exploded side view of the assembly 500. FIG. 27 is a cross sectional view taken along the line M-M in FIG. 26. A pump assembly may further include a standing valve (not shown), traveling valve (in the plunger), and barrel (not shown) and/or other components.

As shown, the adaptor apparatus 100 is positioned between the example plunger 502 and the example reciprocating rod 504. The rod 504 shown in FIG. 27 is a valve rod that connects to the lower end of the sucker rod in this example.

The rod 504 comprises a bottom rod connector portion 506. The bottom rod connector portion 506 engages the top connector portion 106 of the adaptor apparatus 100. More specifically, in this embodiment, the bottom rod connector portion 506 comprises outer threads (not shown) that engage the inner threads of the top connector portion 106.

The plunger 502 has an upper end 510 comprising a pin end connector 512 with outer threads (not shown). The pin end connector 512 engages the bottom connector portion 124 of the adaptor apparatus 100. More specifically, the outer threads of the pin end connector 512 engage the inner threads of the bottom connector 124 of the adaptor apparatus 100.

The two-piece design of the apparatuses 100, 200, 300 and 400 in FIGS. 1 to 23 (i.e. including the upper adaptor pieces (102, 202, 302, 402 and base adaptor pieces 104 that are removably connectable) may allow the same base adaptor piece 104 to be used with various different upper adaptor pieces. That is, the upper adaptor pieces 102, 202, 302 or 402 shown in FIGS. 1 to 23 may be removed from the base adaptor piece 104, and another upper adaptor piece may then be connected to the base adaptor piece 104. The other upper adaptor piece may have the same configuration as the upper adaptor pieces 102, 202, 302 or 402 shown in FIGS. 1 to 23, or other upper adaptor piece may have a different configuration. In some embodiments, the base adaptor piece 104 may be adapted to be used without the upper adaptor piece. For example, the base adaptor piece 104 may be adapted to connect directly to a hollow valve rod.

In some embodiments, rather than being connected to a solid rod via an upper adaptor piece with slots (e.g. upper adaptor piece 102), the base adaptor piece 104 may connect directly to a hollow tube such as a pull tube or hollow valve rod. In such embodiments, rather than fluid being outward through slots into the annulus, the fluid may flow through the interior passage of the hollow tube. In such embodiments, the upper adaptor piece 102, 202, 302 or 402 may be omitted or removed from the base adaptor piece 104 prior to connecting the base adaptor piece to the hollow tube.

Figure 28:
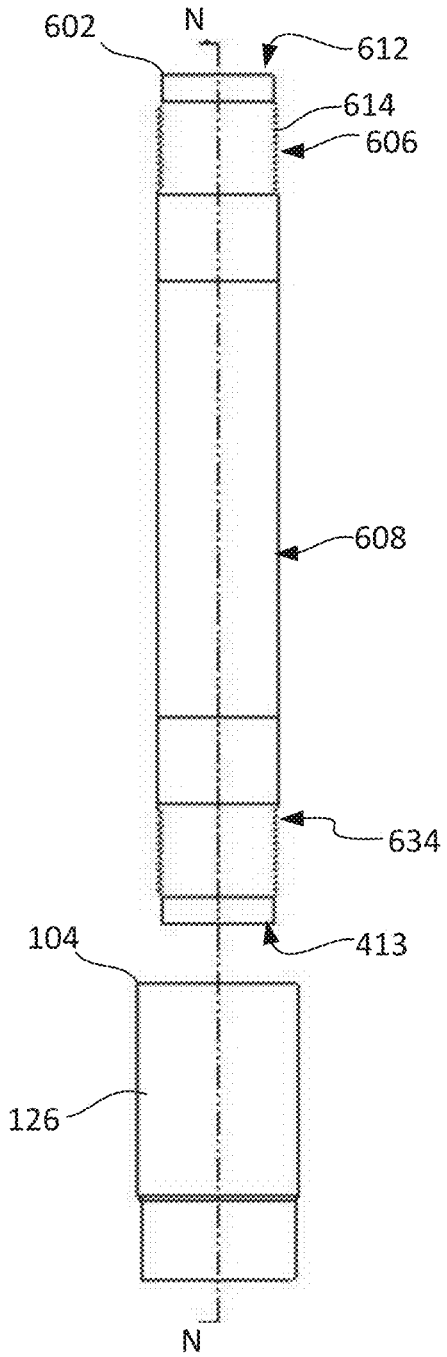
FIG. 28 is an exploded side view of the base adaptor piece of the adaptor apparatus of FIGS. 1 to 8 connected to a hollow valve rod according to some embodiments.
Figure 29:
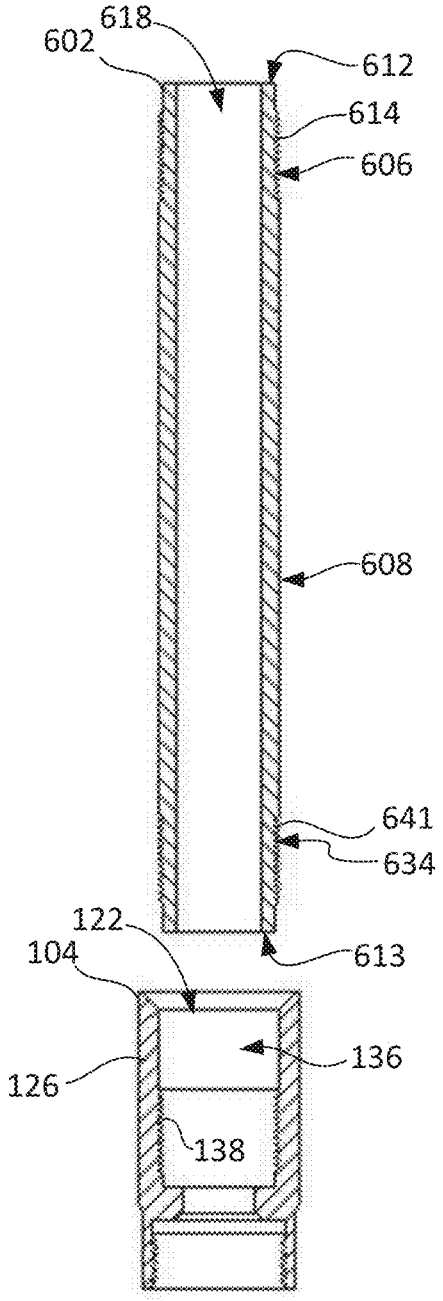
FIG. 29 is an exploded side cross-sectional view of the base adaptor piece and hollow valve rod taken along the line N-N in FIG. 28.

FIG. 28 is an exploded side view of the base adaptor piece 104 of the adaptor apparatus 100 of FIGS. 1 to 8 connected to a hollow valve rod 602 according to some embodiments. FIG. 29 is an exploded side cross-sectional view of the base adaptor piece 104 and hollow valve rod 602 taken along the line N-N in FIG. 28.

The hollow valve rod 602 in this embodiment is tubular, defining a fluid passage 618 completely therethrough from an upper end 612 to a lower end 613. The hollow valve rod 602 includes a top connector portion 606, a lower connector portion 634, and a neck portion 608 therebetween. The lower connector portion 634 is similar to the lower connector portion 134 of the upper adaptor piece 102 shown in FIGS. 1 to 20. That is, the lower connector portion 634 includes outer threads 641 that engage inner threads 138 of the base adaptor piece 104. The lower connector portion 634 and a part of the neck portion 608 is partially received in the upper passage portion 136 of the base adaptor piece 104, with the lower connector portion 634 screwed into the inner threads 138 of the base adaptor piece 104.

The upper connector portion 606 includes outer threads 641 that are to engage inner threads in a lower end of a bushing (not shown) that forms a coupling, or part of a coupling assembly, between the hollow valve rod 602 and the sucker rod.

In this embodiment, the hollow valve rod 602 connects directly to the base adaptor piece 104, and the upper adaptor piece 102 of FIGS. 1 to 8 is omitted. For example, the inner threads 138 of the collar portion 126 may be configured to attach to a hollow valve rod having any one of the following configurations: 15/16 inch outer diameter (OD) tube with 0.9375-16 united national (UN) thread; 1 and 1/8 inch OD tube with 1.1250-16 UN thread; 1 and 5/16 inch OD tube with 1.3125-16 UN thread; or 1 and 1/2" OD tube with 1.5000-16 UN thread. Example hollow valve tube specifications may be found, for example, in the American Petroleum Institute (API) Specification 11AX, "Specification for Subsurface Sucker Rod Pump Assemblies, Components, and Fittings," Thirteenth Edition (2019), the entire content of which is incorporated herein by reference.

Figure 30:
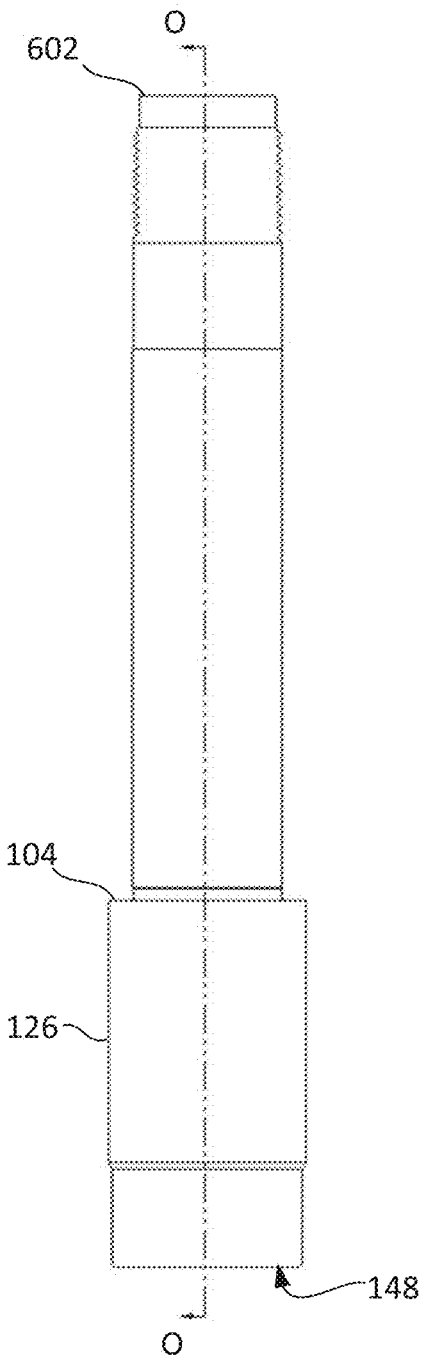
FIG. 30 is a side view of the hollow valve rod and the base adaptor piece, as connected.
Figure 31:
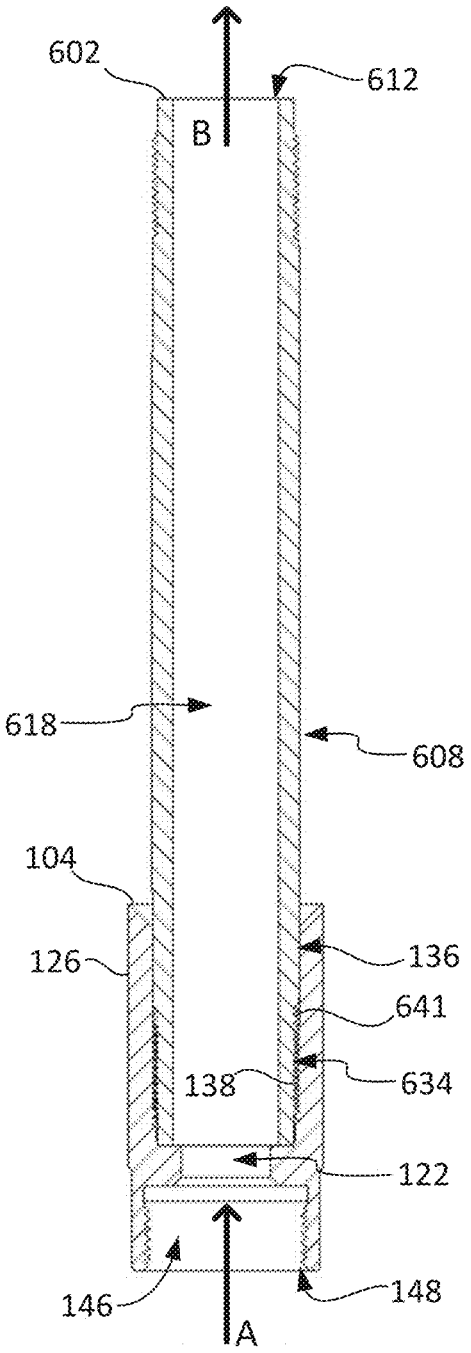
FIG. 31 is aside cross-sectional view of the hollow valve rod and the base adaptor piece taken along the line O-O in FIG. 30.

FIG. 30 is a side view of the hollow valve rod 602 and the base adaptor piece 104 connected. FIG. 31 is aside cross-sectional view of the hollow valve rod 602 and the base adaptor piece 104 taken along the line O-O in FIG. 27.

As shown in FIG. 31, the hollow valve rod 602 is partially received in the upper passage portion 136 of the base adaptor piece 104, with the inner threads 138 of the base adaptor piece 104 engaging the outer threads 641 of the lower connector portion 634 of the hollow valve rod 602. The base adaptor piece 104 overlaps the lower connector portion 634 of the hollow valve rod 602 and part of the neck portion 608.

In operation, fluid exiting the upper end of the plunger enters the base adaptor piece 104 through a bottom end 148 thereof in the direction of the arrow labelled "A" in FIG. 31. The fluid travels upward through the base adaptor piece 104 and the hollow valve rod 602 and exits through the upper end 612 of the hollow valve rod 602 as indicated by the arrow labelled "B". For example, fluid may flow from the hollow valve rod 602 to a valve (not shown).

The base adaptor piece 104 may be used interchangeably with the upper adaptor piece 102 shown in FIGS. 1 to 8 and the hollow valve rod 602 shown in FIGS. 25 to 28. The base adaptor piece 104 may also be used interchangeably with other upper adaptor piece configurations. Thus, the connection apparatuses described herein may be customizable and/or adaptable for a variety of applications. Likewise, the upper adaptor pieces 102, 202, 302 and 402 shown in FIGS. 1 to 23 and the hollow valve rod 602 shown in FIGS. 28 to 31 may each be used with different base adaptor pieces having different configurations. Embodiments are not limited to a particular combination of upper and/or base adaptor pieces.

The apparatuses 100, 200, 300 and 400 shown in FIGS. 1 to 23 may comprise metal, a metal composite, or any other suitable material for use in artificial lift systems. Embodiments are not limited to any particular material composition of the apparatuses.

A method according to some embodiments comprises connecting the adaptor apparatus described herein between a plunger and a reciprocating rod. The apparatus may, for example, be in the form of the apparatuses 100, 200, 300 or 400 shown in FIGS. 1 to 23. The method may further comprise flowing fluid through the adaptor apparatus. The fluid may flow through the apparatus on the downstroke.

A method according to some embodiments may comprise providing an upper adaptor piece and a base adaptor piece. The upper adaptor piece may, for example, be in the form of the upper adaptor piece 102, 202, 302 or 402 of the apparatuses 100, 200, 300 or 400 shown in FIGS. 1 to 23. The method may further comprise providing a base adaptor piece connectable to the upper adaptor piece. The base adaptor piece may, for example, be in the form of the base adaptor piece 104 shown in FIGS. 1 to 23. "Providing" the upper or base adaptor piece may comprise making, manufacturing, purchasing, or otherwise obtaining the upper or base adaptor piece.

The method may further comprise connecting the upper adaptor piece to the base adaptor piece to form an adaptor apparatus for use in an artificial lift system. The method may further comprise using the adaptor apparatus as described herein.

In some embodiments, the upper or base adaptor piece may be provided separately.

It is to be understood that a combination of more than one of the approaches described above may be implemented. Embodiments are not limited to any particular one or more of the approaches, methods or apparatuses disclosed herein. One skilled in the art will appreciate that variations or alterations of the embodiments described herein may be made in various implementations without departing from the scope of the claims.

What is claimed is:

1. An adaptor apparatus for coupling between a rod and a plunger in a downhole artificial lift system, the apparatus comprising:

a top connector portion for coupling to first equipment;

a neck portion below the top connector portion; and a bottom connector portion, below the neck portion, for coupling to second equipment, the adaptor apparatus having a longitudinal axis extending through the top connector portion, the neck portion, and the bottom connector portion, and the apparatus defining a longitudinal fluid passage extending through the bottom connector portion and into the neck portion, wherein the neck portion comprises at least one slot extending from an outer surface of the neck portion to the fluid passage and, for each at least one slot, a respective fluid channel comprising a groove recessed into the outer surface of the neck portion and extending from the slot, and wherein, for each fluid channel, the respective groove has a flat floor.

2. The apparatus of claim 1, wherein the first equipment comprises the rod, and the second equipment comprises the plunger.

3. The apparatus of claim 1, wherein each slot is a perforation extending radially through the neck portion, each perforation having an elongated profile, the elongated profile having a major axis relative to the longitudinal axis.

4. The apparatus of claim 3, wherein each at least one slot has an obround-shaped profile.

5. The apparatus of claim 3, wherein each at least one fluid channel extends from a respective upper end of the corresponding slot.

6. The apparatus of claim 1, wherein each groove is oriented at the helix angle relative to the longitudinal axis.

7. The apparatus of claim 1, wherein the fluid channels each define a helical path.

8. The apparatus of claim 1, wherein the fluid channels each define a straight path.

9. The apparatus of claim 1, wherein the fluid channel decreases in depth as it extends away from the corresponding slot.

10. The apparatus of claim 1, further comprising a collar portion intermediate the bottom connector portion and the neck portion, the collar portion having a larger outer diameter than the neck portion and the top connector portion.

11. A method comprising:

connecting the adaptor apparatus of claim 1 between a plunger and a rod.

12. The method of claim 11, further comprising flowing fluid through the adaptor apparatus.

13. An assembly for a downhole artificial lift system comprising:

a plunger;

an adaptor apparatus comprising:

a reciprocating rod;

a top connector portion for coupling to the rod;

a neck portion below the top connector portion; and a bottom connector portion, below the neck portion, coupled to the plunger, the adaptor apparatus having a longitudinal axis extending through the top connector portion, the neck portion, and the bottom connector portion, and the apparatus defining a longitudinal fluid passage extending through the bottom connector portion and into the neck portion, wherein the neck portion comprises at least one slot extending from an outer surface of the neck portion to the fluid passage and, for each at least one slot, a respective fluid channel comprising a groove recessed into the outer surface of neck portion and extending from the slot, wherein, for each fluid channel, the respective groove has a flat floor.

14. The assembly of claim 13, wherein each slot is a perforation extending radially through the neck portion, each perforation having an elongated profile, the elongated profile having a major axis oriented at a helix angle.

15. The assembly of claim 14, wherein each at least one fluid channel extends from a respective upper end of the corresponding slot.

16. The assembly of claim 15, wherein each groove is oriented at the helix angle relative to the longitudinal axis.

17. The assembly of claim 13, wherein the fluid channels each define a helical path.

18. The assembly of claim 13, wherein the fluid channels each define a straight path.

19. The assembly of claim 13, wherein the fluid channel decreases in depth as it extends away from the corresponding slot.

* * * * *